United States Patent [19]

Cordova

[11] Patent Number: 5,052,417

[45] Date of Patent: Oct. 1, 1991

[54] EYE SHADOW COLLECTOR

[76] Inventor: Orlando Cordova, #69 Beadel St., Apt. 4, Brooklyn, N.Y. 11222

[21] Appl. No.: 335,380

[22] Filed: Apr. 10, 1989

[51] Int. Cl.[5] ..... A45D 40/30

[52] U.S. Cl. ..... 132/216; 132/319

[58] Field of Search ..... 132/216, 217, 218, 319, 132/320; 128/857, 858; 2/9, 15

[56] References Cited

U.S. PATENT DOCUMENTS

| | | | |
|---|---|---|---|
| D. 252,890 | 9/1979 | Cavalieri | D28/7 |
| D. 254,935 | 5/1980 | Staudinger | D28/7 |
| D. 255,606 | 6/1980 | Garcia | D28/9 |
| D. 271,530 | 11/1983 | Watt | D28/7 |
| 1,873,928 | 8/1932 | Bohner | 132/216 |
| 1,974,825 | 9/1934 | Lovie | 132/216 |
| 3,016,059 | 1/1962 | Hutton | 132/217 |
| 3,619,815 | 11/1971 | Towner, Jr. | 2/12 |
| 3,789,856 | 2/1974 | Bomba | 132/319 |
| 4,033,364 | 7/1977 | Inzana et al. | 132/216 |
| 4,621,378 | 11/1986 | Hatchman | 2/9 |
| 4,768,528 | 9/1988 | Steele, Jr. | 132/213 |
| 4,807,650 | 2/1989 | Bliss | 132/319 |

FOREIGN PATENT DOCUMENTS

| | | | |
|---|---|---|---|
| 350794 | 10/1937 | Italy | 132/217 |

*Primary Examiner*—John J. Wilson
*Assistant Examiner*—Frank A. LaViola
*Attorney, Agent, or Firm*—Sixbey, Friedman, Leedom & Ferguson

[57] ABSTRACT

The present invention discloses an instrument for collecting eye shadow during cosmetics application. The instrument includes a collector which collects particles of eye shadow that do not adhere to the eyelids during the application of eye shadow to a subject. The collector also prevents the particles of eye shadow from contacting and adhering to additional areas of the face of the subject. The collector has a U-shaped collecting surface having a face-engaging edge. The U-shaped collecting surface has a width greater than the width of the eye. A handle attached to the collector holds the collector in position underneath the eye of the subject during use. The handle includes a loop portion shaped to fit on a finger, and the handle is connected to the collector at the end of the collecting surface opposite the face engaging surface. This allows the handle to be disposed on one finger while another finger of the same hand positions the eye and eyelid and the face-engaging edge of the collector engages the face of the subject below the eye. A collector pad is removably mounted on the collector and has substantially the same surface area as the collecting surface of the collector.

18 Claims, 2 Drawing Sheets

EYE SHADOW COLLECTOR

TECHNICAL FIELD

The present invention is directed to an instrument for facilitating the application of cosmetics. More particularly, the present invention is directed to a collector for eye shadow which prevents eye shadow particles from falling onto and adhering to the face.

BACKGROUND OF THE INVENTION

Shields used to protect portions of the body during the application of cosmetics to other parts of the body are well known. For example, Watt, U.S. Pat. No. D271,530 Cavalieri, U.S. Pat. No. D252,890; and Staudinger, U.S. Pat. No. D254,935 all disclose various types of mascara shields. These shields protect the region of the eye during the application of mascara by preventing the mascara from running or smudging on the areas surrounding the eye. However, these devices are not convertible for use with eye shadow.

As mascara shields, these devices are used by being placed with a flat shielding surface disposed under the eye and against the face. The shielding surface is used as a supporting surface against which the eyelashes rest. If these devices were used properly, with their shielding surface flat against the face they could not collect eye shadow if attempted to be used as an eye shadow collector. The eye shadow particles would simply slide off. If these devices were attempted to be used as an eye shadow collector by holding the shielding surface perpendicular to the face in a substantially horizontal position, they would still be unsuccessful for numerous reasons. Because of their curved edges designed to follow the curve of an eyelash, when placed against the face gaps would exist through which eye shadow particles could fall. The entire area of the eye could not be protected simultaneously, rendering these devices effectively useless. In any event, the flat surfaces will not sufficiently hold eye shadow particles. Also, many of the surfaces are not large enough. Moreover, some of these devices have shapes that make them awkward and dangerous to use in this position because in holding the device the hand will block the eye. In applying mascara without a clear view of the subject eye, the chances of poking and injuring the eye increase greatly. Additionally, some of these devices have long handles that prevent them from being held with one hand while the same hand positions the eye for mascara application.

Applicant knows of no device that can be used during the application of eye shadow to protect the face from stray eye shadow particles. No known device can perform this function while being held in one hand while the other hand is free to apply the eye shadow.

SUMMARY OF THE INVENTION

It is an object of this invention to provide a device for shielding the face from stray eye shadow particles during the application of eye shadow.

It is another object of this invention to provide an eye shadow collector that permits the application of eye shadow and the face shielding function to be performed simultaneously using only two hands.

These and other objects are attained by the eye shadow collector instrument of the present invention. The eye shadow collector instrument includes a collector which collects particles of eye shadow that do not adhere to the eyelids during the application of eye shadow to a subject. The collector also prevents the particles of eye shadow from contacting and adhering to additional areas of the face of the subject. The collector has a U-shaped collecting surface having a face-engaging edge. The U-shaped collecting surface has a width greater than the width of the eye. A handle attached to the collector holds the collector in position underneath the eye of the subject during use. The handle includes a loop portion shaped to fit on a finger, and the handle is connected to the collector at the end of the collecting surface opposite the face-engaging surface. This allows the handle to be disposed on one finger while another finger of the same hand positions the eye and eyelid and the face-engaging edge of the collector engages the face of the subject below the eye. A collector pad is removably mounted on the collector and has substantially the same surface area as the collecting surface of the collector.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
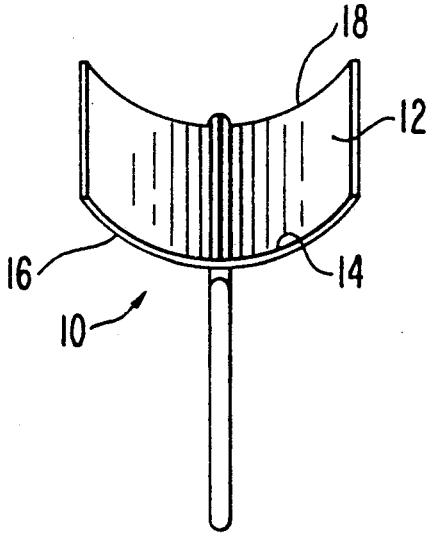
FIG. 1 is a front view of the eye shadow collector of the present invention.
Figure 2:
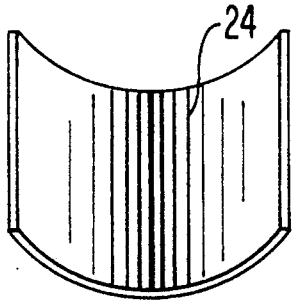
FIG. 2 is a front view of a disposable pad used with the eye shadow collector of FIG. 1.
Figure 3:
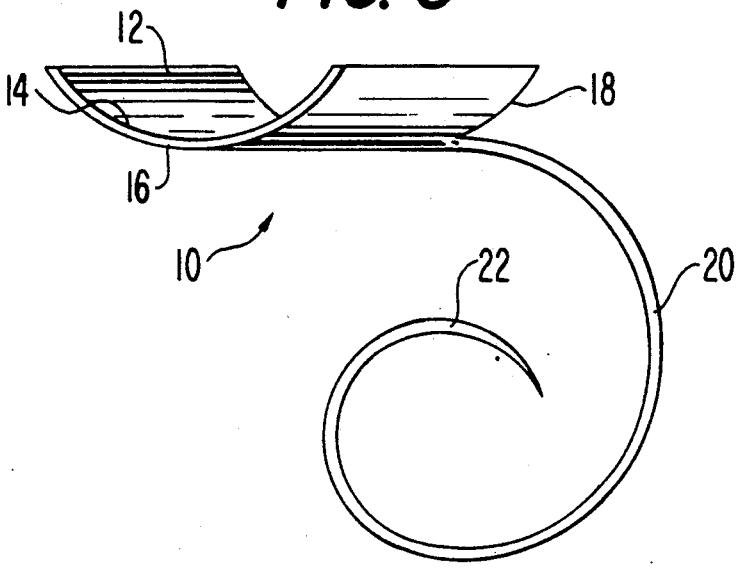
FIG. 3 is a perspective view of the eye shadow collector of FIG. 1.

As shown in the figures, eye shadow collector instrument 10 includes two main portions, collector 12 and handle 20, and may be formed of any suitable material including wood, plastic, or metal. Collector 12 includes U -shaped collecting surface 14 which preferably has a width greater than that of the eye. The U shape is formed by bending upwardly out of the plane of collecting surface 14 the ends of the collecting surface. U-shaped surface 14 has face engaging edge 16 and opposite edge 18. Handle 20 preferably is attached to collector 12 at the center of opposite edge 18. Handle 20 includes loop portion 22 which engages the finger of a user. Loop portion 22 preferably is formed of a springy, biased material and is formed as an open loop. Loop portion 22 is not a complete, closed loop. This allows loop portion 22 to expand and contract to conform to the size of the finger of the user of instrument 10. The loop of loop portion 22 lies in a plane substantially perpendicular to a plane that is tangent to the lowermost portion of the U shape of collecting surface 14. Removable pad 24 can be removably fixed to U-shaped surface 14 of collector 12 by means of adhesive. Removable pad 24 may be made of cotton and is disposable. Removable pad 24 is used for sanitary purposes.

Figure 4:
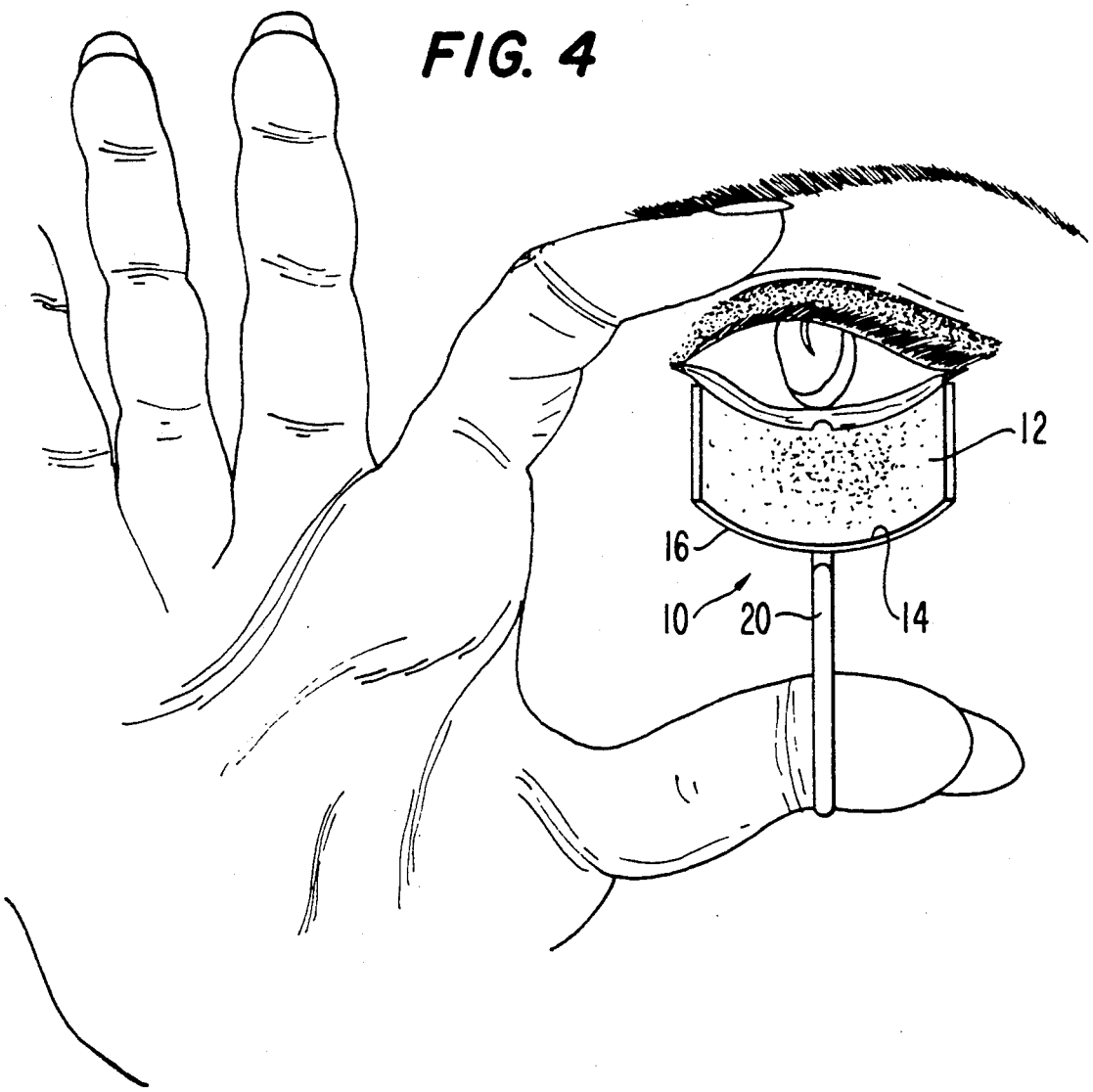
FIG. 4 shows the eye shadow collector of FIG. 1 in use.

When eye shadow is applied to the eyelids of a subject, eye shadow collector instrument 10 is simultaneously positioned to protect the face of the subject. An eye shadow applicator is held in one hand of the user while the user's other hand positions the eye and eyelid for application and simultaneously protects the face with eye shadow collector instrument 10 as shown in FIG. 4. The user may be the subject or the user may be a second party applying cosmetics to the face of the subject. One finger of the hand holding instrument 10 is disposed within loop portion 22 of handle 20 while the other fingers are free to position the eye and eyelid. As the eye and eyelid are positioned, and while the applicator is applying eye shadow, face-engaging edge 16 of U-shaped collecting surface 14 is disposed against the face under the eye. As eye shadow is applied, any stray particles that fall from the eye are caught and collected by U-shaped collecting surface 14 of collector 12. When removable pad 24 is used, the stray eye shadow particles adhere to the pad. Also, after eye shadow is applied to both eyes, removable pad 24 may be disposed of and a sterile pad may be used during the next application. Additionally, it is preferable that U-shaped collecting surface 14, or removable pad 24 where used, be formed of a woven or textured material to improve its ability to retain particles of eye shadow.

The eye shadow collector instrument 10 shields the face of a subject during the application of eye shadow and permits the application of eye shadow and the shielding of the face from eye shadow particles to be performed simultaneously using only two hands. Eye shadow collector instrument 10, through the use of removable pad 24, may be reused while remaining sanitary and easily sterilizable. The shape of U-shaped surface 14 and face engaging edge 16 permit the eye shadow collector instrument to be placed against the face for the collection of eye shadow without any gaps forming between the face and the instrument through which eye shadow particles can fall.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. An instrument for facilitating the application of facial cosmetics to eyelids and eyelashes comprising:

a collector means for collecting particles of facial cosmetics that to not adhere to the eyelids during the application of such cosmetics to a subject and for preventing the particles of facial cosmetics from contacting and adhering to additional facial areas of the subject, said collector means comprising a collecting surface having a face-engaging edge; and a handle means for positioning said collector means substantially perpendicular to the facial areas underneath an eye of the subject, said handle means comprising a loop portion shaped to fit on a finger, said handle means being connected to said collector means so that said handle means can be disposed on one finger of a hand while another finger of the hand positions the eye and eyelid and said face engaging edge of said collector means engages the face of the subject below the eye;

wherein said collecting surface is U-shaped and a valley of said U-shaped collecting surface extends longitudinally away from said face-engaging edge and collects the particles which do not adhere to the eyelids and prevents the particles of facial cosmetics from contacting and adhering to facial areas of the subject.

2. An instrument according to claim 1 further comprising a collector pad removably mounted on said collector means and having a surface area substantially equal to that of said collecting surface of said collector means.

3. An instrument according to claim 1 wherein a width of said collecting surface is greater than a width of the eye.

4. An instrument according to claim 1 wherein said loop portion of said handle means lies in a plane substantially perpendicular to a plane including said collecting surface of said collector means.

5. An instrument according to claim 1 wherein said loop portion is formed of a springy open loop of material to conform to fingers of different diameters.

6. An instrument according to claim 1 wherein said U shape of said collecting surface of said collector means is formed by bending upwardly out of the plane of said collecting surface opposed ends of said collecting surface.

7. An instrument according to claim 1 wherein said handle means is connected to said collector means at an edge of said collecting surface opposite said face-engaging edge.

8. An instrument according to claim 7 wherein said handle means is connected to said collector means substantially at a central portion of said edge opposite said face-engaging edge.

9. An instrument for collecting particles during the application of facial cosmetics to eyelids and eyelashes comprising:

a collector which collects particles of the facial cosmetics that do not adhere to the eyelids during the application of the facial cosmetics to a subject and which prevents particles of the facial cosmetics from contacting and adhering to additional facial areas of the subject, said collector comprising a U-shaped collecting surface having a face-engaging edge, said U-shaped collecting surface having a width greater than a width of an eye of the subject;

a handle for holding said collector in position underneath the eye of the subject, said handle comprising a loop portion shaped to fit on a finger, said handle being connected to said collector at an edge of said collecting surface opposite said face engaging edge so that said handle can be disposed on one finger of a hand while another finger of the hand positions the eye and eyelid and said face-engaging edge of said collector engages the face of the subject below the eye; and a collector pad removably mounted on said collector and having a surface area substantially equal to said collecting surface of said collector.

10. An instrument according to claim 9 wherein said loop portion of said handle lies in a plane substantially perpendicular to a plane including said collecting surface of said collector.

11. An instrument according to claim 9 wherein said U-shape of said collecting surface of said collector means is formed by bending upwardly out of the plane of said collecting surface opposed ends of said collecting surface.

12. An instrument according to claim 11 wherein said loop portion of said handle lies in a plane substantially perpendicular to a plane tangent to the lowermost portion of the U shape of said collecting surface.

13. An instrument according to claim 12 wherein said handle is connected to said collector substantially at the center of said edge opposite said face-engaging edge.

14. An instrument for facilitating the application of facial cosmetic to eyelids and eyelashes of a subject comprising:

a collector means for collecting particles of facial cosmetics including a collecting surface having a face-engaging edge; and means for positioning said collecting surface substantially perpendicular to facial areas underneath the eye of the subject, wherein said collecting surface is U-shaped and a valley of said U-shaped collecting surface extends longitudinally away from said face engaging edge and collects the particles which do not adhere to the eyelids and prevents the particles of facial cosmetics from contacting and adhering to facial areas of the subject.

15. An instrument according to claim 14 wherein a width of said collecting surface is greater than a width of the eye.

16. An instrument according to claim 14 wherein said means for positioning said collector means is a handle and said handle includes a loop portion shaped to fit on a finger, with the loop portion of said handle means positioned substantially perpendicular to a plane including said collecting surface of said collector means.

17. An instrument according to claim 14 wherein said handle is connected to said collector means at an edge of said collecting surface opposite said face-engaging edge.

18. An instrument for facilitating the application of facial cosmetic to eyelids and eyelashes of a subject comprising:

a collector means for collecting particles of facial cosmetics including a collecting surface having a face-engaging edge;

a handle means for facilitating the positioning of said collector means underneath the eye of the subject, substantially perpendicular to said facial areas; and a collector pad removably mounted on said collector means and having a surface substantially equal to that of said collecting surface of said collector means;

wherein said collector means collects the particles which do not adhere to the eyelids and prevents the particles of facial cosmetics from contacting and adhering to facial areas of the subject.

* * * * *